US006467111B1

(12) United States Patent
Vrzalik et al.

(10) Patent No.: US 6,467,111 B1
(45) Date of Patent: Oct. 22, 2002

(54) MEDICAL BED SYSTEM WITH INTERCHANGEABLE MODULES FOR MATTRESS SYSTEMS AND RELATED METHODS

(75) Inventors: John H. Vrzalik, San Antonio, TX (US); Cesar Z. Lina, Universal City, TX (US)

(73) Assignee: KCI Licensing, Inc., San Antonio, TX (US)

( * ) Notice: Subject to any disclaimer, the term of this patent is extended or adjusted under 35 U.S.C. 154(b) by 0 days.

(21) Appl. No.: 09/523,620

(22) Filed: Mar. 13, 2000

(51) Int. Cl.[7] ..... A61G 7/057
(52) U.S. Cl. ..... 5/600; 5/423; 5/914
(58) Field of Search ..... 5/600, 423, 713, 5/726, 652.2, 658, 914

(56) References Cited

U.S. PATENT DOCUMENTS 4,949,413 A * 8/1990 Goodwin ..... 5/713
4,962,552 A * 10/1990 Hasty ..... 5/713
5,062,171 A * 11/1991 Vrzalik ..... 5/713
5,181,288 A * 1/1993 Heaton et al. ..... 5/914
5,216,768 A 6/1993 Bodine et al.
5,267,364 A * 12/1993 Volk ..... 5/713
5,542,136 A * 8/1996 Tappel ..... 5/713
5,594,963 A * 1/1997 Berkowitz ..... 5/713
5,611,096 A * 3/1997 Bartlett et al. ..... 5/713
5,630,238 A 5/1997 Weismiller et al.

* cited by examiner

*Primary Examiner*—Michael F. Trettel

(57) ABSTRACT

The present invention teaches mechanisms and methods of adapting a low air loss inflatable mattress to be mounted within a conventional hospital bed frame, in such a manner so that the power/control module is both mounted in the cavity on the underside of the foot end modified baseboard of the bed, and readily accessible to a caregiver of the user of the bed as modified. The modification process involves substituting a foot end baseboard, to which the power/control module has been attached, for the foot end baseboard supplied with the bed, and bed frame, as manufactured. A variety of existing control modules and blower systems can be modified to operate in this manner.

7 Claims, 5 Drawing Sheets

MEDICAL BED SYSTEM WITH INTERCHANGEABLE MODULES FOR MATTRESS SYSTEMS AND RELATED METHODS

FIELD OF THE INVENTION

The present invention relates to modular therapeutic patient support systems. More particularly, this invention relates to therapeutic beds, therapeutic mattresses adaptable to varying types of surfaces, and modifications and controls which enable therapeutic bed frames to sequentially and independently accept various therapeutic supports depending upon a patient's particular therapeutic needs.

BACKGROUND

The field of therapeutic patient supports has been well developed since at least the 1960s and 70s. While various kinds of therapeutic patient supports exist, inflatable therapeutic patient supports have, over time, become increasingly popular. These supports are more complex than a conventional medical therapeutic mattress as they require additional control systems to regulate the inflation of all or part of the mattress. Such early therapeutic beds were very expensive, requiring complicated control systems to be integrated within the dedicated bed frame supporting the inflatable surface. These systems, which still exist today, still require dedicated bed frames, and, to the extent practical, are restricted to patients requiring a high level of patient care, beyond that provided by a static, pressure relieving mattress.

Through the years, therapeutic patient support system purchasers, mostly health care providers, began demanding static pressure relieving mattress systems that were adapted for use with conventional bed frames, which did not require the uses of a dedicated frame, as do more complex systems referred to above. These conventional bed frames, as is well known in the art, generally have front or rear portions, and usually both, that may be raised, or lowered, as desired, commonly by means of patient remote controllable electric motors. As a consequence, the baseboards of such beds are articulable, and are divided into a plurality of independently moveable planar sections, most usually a head section, a body section, and a foot section. This allowed, and allows, a health care provider, such as a hospital, to use different therapeutic mattress system with the same bed frame. This also allowed bed frames to be moved among various services as patient census may dictate.

A typical example is the First Step Select® mattress system available from Applicant. This system provides an inflatable, low-air-loss patient support with multiple zones of pressure control, together with heater control and other features. A compact control unit that was adapted to be hung on the footboard of a standard hospital bed frame regulates all of these features. Such a system enables a conventional hospital bed to be equipped with a standard medical mattress for most patients, but when required a low air loss mattress could be installed instead, with the mattress control system mounted (or hung) upon the footboard of the bed. Other such mattress systems were also offered under the "MRS" (mattress replacement system) designation to replace the entire mattress.

Significant problems arise from placing controls on the bed footboard. This footboard is valuable space and typically is the preferred location for putting patient clipboards, and other frequently used devices. This allows them to be placed both close to the patient, and to be readily accessible to medical caregivers. Also, a patient care room is often cluttered. Having a protrusion beyond the preexisting footprint of the bed could lead to the controls, and the bed attached thereto being inadvertently jostled. This could lead to patient discomfort, or worse.

As is well known in the art, conventional medical bed frames, generally have front or rear portions that may be raised, or lowered, as desired, commonly by means of patient controllable electric motors. As a consequence, the baseboards, which support the mattress of such beds are articulable, and are divided into a plurality of independently moveable planar sections, including at least a head section, a body section, and a foot section. Further, the space beneath the baseboards is not empty.

Conventional medical bed frames typically use electrically driven mechanisms, such as jackscrews or worm gears for adjusting the elevation and inclination of the various portions of the bed. Most commonly this mechanism is centrally disposed on the underneath of the baseboards, and occupies some portion of the centerline portion of the space there defined, much like the well known transmission hump long found in rear wheel drive automobiles equipped with automatic transmissions. Fortunately, likely for mechanical reasons, this configuration is reasonably standard.

More recently, various other bed frames have been commercialized with a modularized approach, wherein the bed frame is adapted for a variety of mattress systems. The Total Care system, commercialized by Hill-Rom, Inc., of Batesville, Ind., is a typical example. That system is commercialized with a bed frame that is customized during manufacture to receive a variety of different surfaces. Particulars of this system may be better understood from the following U.S. Patents where are believed to be related to the Total Care System U.S. include U.S. Pat. No. 5,630,238 issued May 20, 1997, Weismiller et al, incorporated herein by this reference thereto.

To date, however there has been no patient support system which provides an inflatable pressure relieving patient support system which coacts with a conventional medical bed frame to provide a low air loss inflatable mattress which is contained within such a bed frame, which also has its control and power modules also located within the footprint of such a bed. It is towards meeting this need that the present invention is directed.

BRIEF DESCRIPTION OF THE INVENTION

The present invention embodies an inflatable patient support, and a control and power system required for its operation, which fit within, beneath, and upon a conventional hospital bed frame, after the bed frame has been internally modified. The system operatively interacts with a bed frame, and comprises a modular control assembly, an inflatable mattress and various operative connections there between. In the preferred embodiment this is a conventional bed frame that, although modified to receive the modular control assembly may also support a wide variety of other mattresses as are typically employed within the medical environment.

Then, when a pressure-relieving surface is required, the foot end baseboard of the frame can be removed and replaced with the modular control assembly and mattress can be utilized with the system without the necessity of utilizing a blower control assembly that hangs on the footboard or is placed on the floor in the patient room.

An object of the present invention is to provide a means whereby a low air loss inflatable pressure-relieving mattress, and the power/control module thereof, may be installed upon and within the footprint of a conventional hospital bed.

Another object of the present invention is to provide a means whereby a low air loss inflatable pressure-relieving mattress, and the power/control module thereof, may be installed upon and within the footprint of a conventional hospital bed, wherein the controls are accessible to a caregiver of the user of the mattress.

A further object of the present invention is to provide a means whereby a low air loss inflatable pressure-relieving mattress, and the power/control module thereof, may be installed upon and within the footprint of a conventional hospital bed, by locating this module within space otherwise wasted in the cavity beneath the foot end baseboard of a conventional hospital bed.

These and still further objects and advantages of the invention will be readily apparent to those skilled in the art from the following description taken in conjunction with the accompanying drawings. The drawings constitute part of this specification and include exemplary embodiments of the present invention and illustrate various objects and features thereof.

DETAILED DESCRIPTION OF THE PREFERRED EMBODIMENTS

Figure 1:
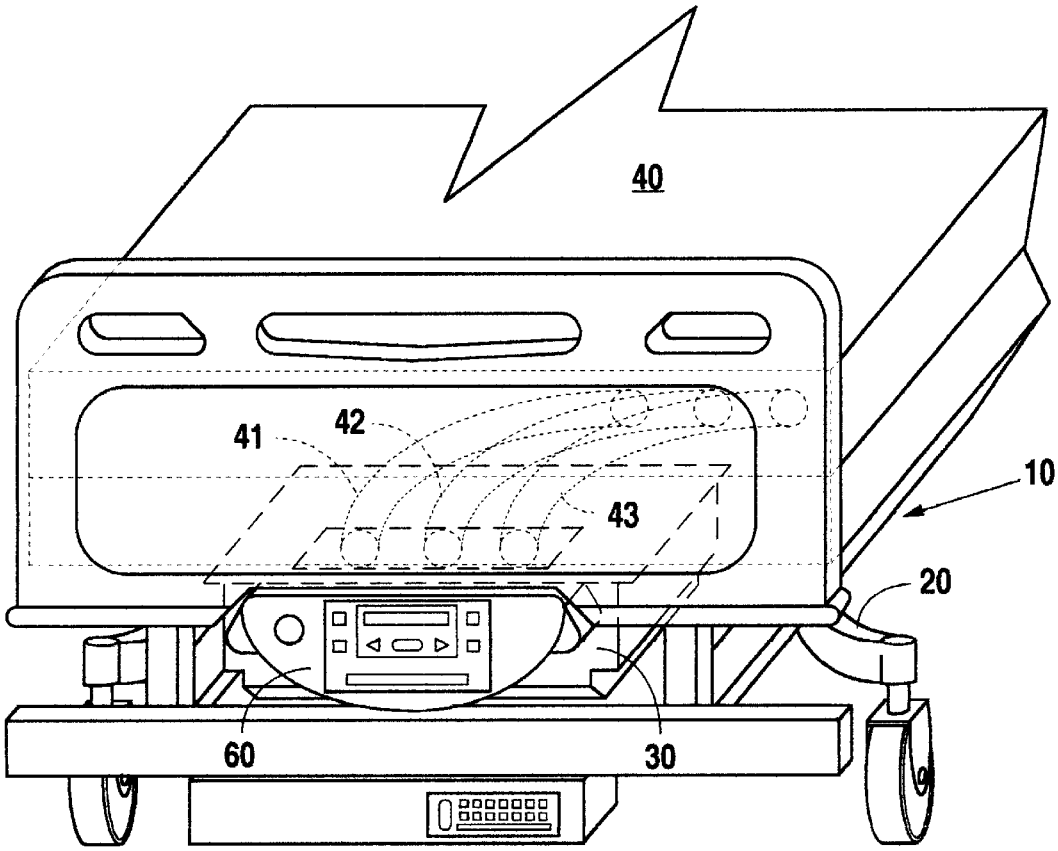
FIG. 1 is a partial isometric perspective view of a therapeutic patient support system embodying the various aspects of the present invention.

The present invention may be embodied in a wide variety of therapeutic patient support systems. FIGS. 1–4 depict a first preferred embodiment of the present invention represented within therapeutic patient support system 10. As most clearly illustrated in FIG. 1, the system 10 operatively interacts with a bed frame 20, and comprises a modular control assembly 30, a mattress 40, and various operative connections there between.

In the preferred embodiment, frame 20 is a conventional bed frame that, although modified to receive modular control assembly 30, may also support a wide variety of other mattresses as are typically employed within the medical environment. Then, when a pressure-relieving surface is required, the foot end baseboard of frame 20 can be removed and replaced with the modular control assembly 30, and mattress 40 can be utilized with the system without the necessity of utilizing a blower control assembly that hangs on the footboard or is placed on the floor in the room.

More particularly, frame 20 of the presently most preferred embodiment is a Hill-Rom Model 834A or 835 frame that has been adapted to allow space for receiving the modular control assembly 30. Such conventional bed frames are available with baseboards including a foot section baseboard of the same shape as baseboard 31. In contrast to a spring surface, such baseboards are suited for use in the medical industry when therapeutic mattresses, are installed upon bed frame 20.

Figure 2:
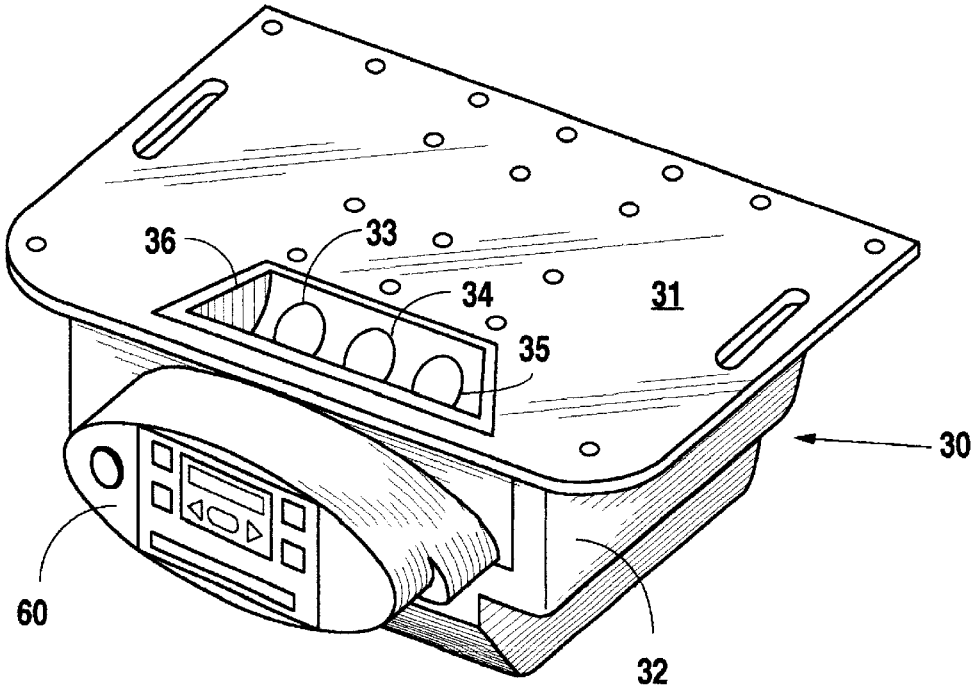
FIG. 2 is a top perspective view of the modular control assembly.
Figure 3:
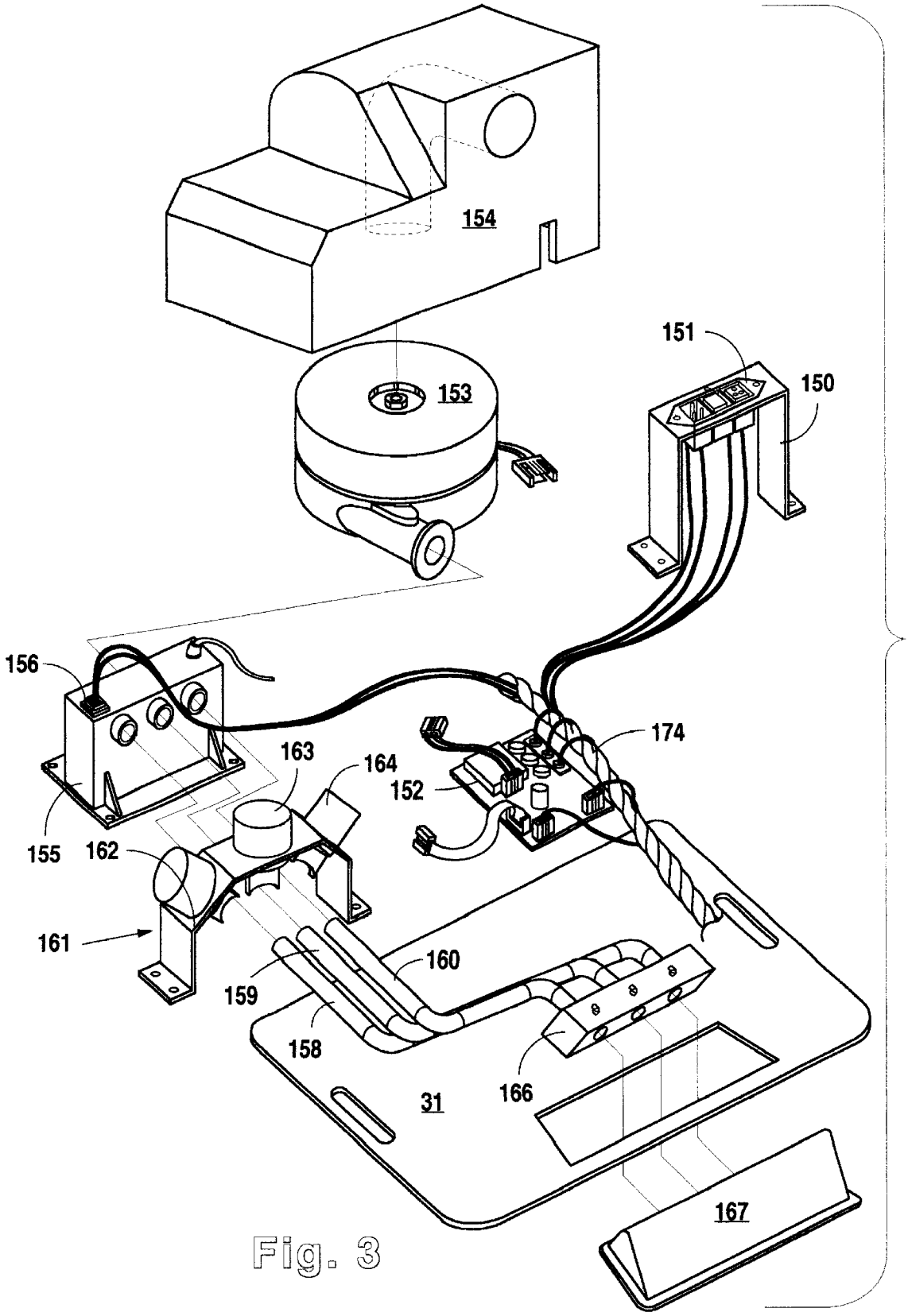
FIG. 3 is a partial exploded view of the modular control assembly of FIG. 2.

With reference to FIGS. 2 and 3, modular control assembly 30 comprises baseboard 31, blower control assembly 32 attached thereto, and air hose outlets 33–35, which are provided within recess 36 defined within baseboard 31. In the usual operating configuration, hose 41 is operatively connected to outlet 33, hose 42 is operatively connected to outlet 34, and hose 43 is operatively connected to outlet 35. The precise function and uses of hoses 41, 42, 42, when connected to outlets 33, 34, 35, is described more fully below.

FIG. 2 shows the molded, plastic shroud 200 that covers the individual components of blower control assembly 32. Shroud 200 is described in greater detail, below.

FIG. 3 depicts in exploded view the devices and components of an exemplary embodiment of blower control assembly 32. Power switch assembly 151 is mounted to bracket 150 and is equipped to receive a conventional power cord. Assembly 151 has a rocker style toggle switch to interrupt or allow flow of electrical power to the electronic control board 152, that in turn processes signals and directs electrical power to blower motor 153 and to pinch valves 162, 163, and 164, which are mounted on hose valve mounting bracket 165.

Foam block 154 fits snugly over blower motor 153 to reduce noise and vibration from blower motor 153. Blower motor 153 is seated in a Styrofoam nest, which sets snugly into a shallow, rectangular metal frame 176. Metal frame 176 is affixed to baseboard 31 by machine screws. No bolts, or strap holds the blower motor to baseboard 31. This is so to prevent and/or reduce transmitting mechanically induced vibration from blower motor 153 to bed frame 20. Blower motor 153 is held in place by virtue of mechanical pressure exerted by the shroud 200 pressing upon foam block 154.

Electric wires and spaghetti air tubes are "dressed" around various components by means of commercially available management appliances, such as open spiral cable wrap tubing and cable tie down clamps, as are well known to those skilled in the art.

The air output chamber of blower motor 153 is mechanically linked to air/heater manifold 155. Temperature sensor 156 is affixed to and imbedded into manifold 155. Temperature sensor 156 is also electrically linked to control board 152, and provides blower air temperature signals to control board 152 for processing along with other signals.

Further referring to FIG. 3, three air hoses 158, 159, and 160 proceed from air/heater manifold 155 and continue through, in substantially parallel configuration, valve assembly 161. Three pinch valve controllers 162, 163, and 164 are mounted onto valve assembly 161, directly above each air hose 158, 159, and 160, respectively.

Figure 4:
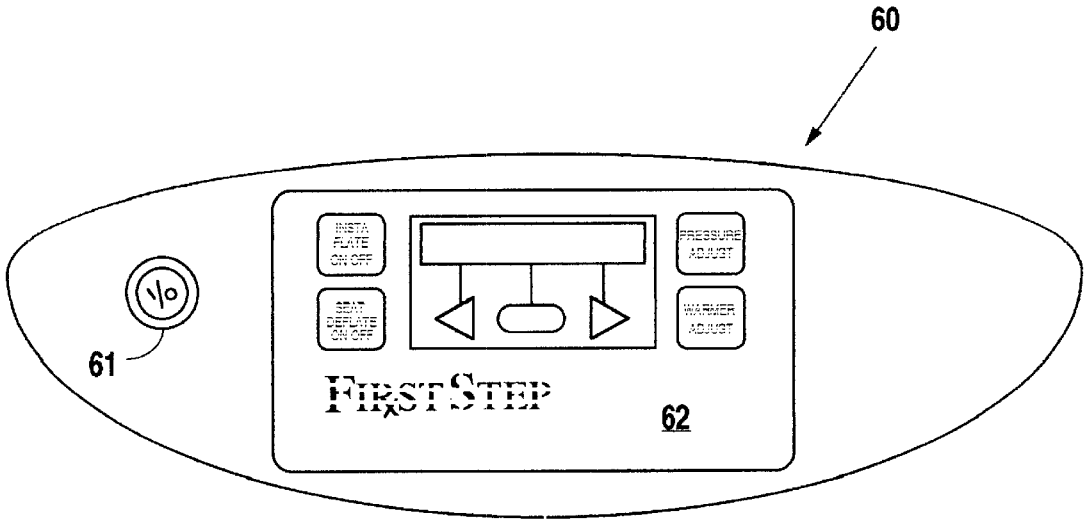
FIG. 4 is a front view of the control panel of the modular control assembly

As shown in FIG. 4, the preferred embodiment of the present invention is adapted to provide customers with one of the popular First Step Select mattress systems available from Applicant. FIG. 4 depicts a control panel 60 for such a system. Control panel 60 includes a power button 61 and a First Step Select membrane panel 62 as is presently commercialized with the First Step Select blower unit. The functions of the First Step Select membrane panel and its related components are virtually identical to the function of like components and controls in the First Step Select mattress systems presently on the market. Hence, once modular control assembly 30 has been installed within therapeutic patient support system 10, and once mattress 40 and its related air hoses 41–43 have been connected to outlets 33–35, respectively, system 10 is ready to provide patient pressure relief and other therapeutic features for patients.

In an alternative embodiment, TheraPulse Light control panel 60' may replace the deformed elongated oval FirsStep Select control panel 60. The TheraPulseLight control panel and basic air handling components used therewith, are the same as are used in the commercialized TheraPulseLight unit sold by assignee. The face 201' of this control panel 60' is an elongated irregular hexagon. Either of such shapes, or any other desirable shaped control panel 60 could be used.

Figure 5:
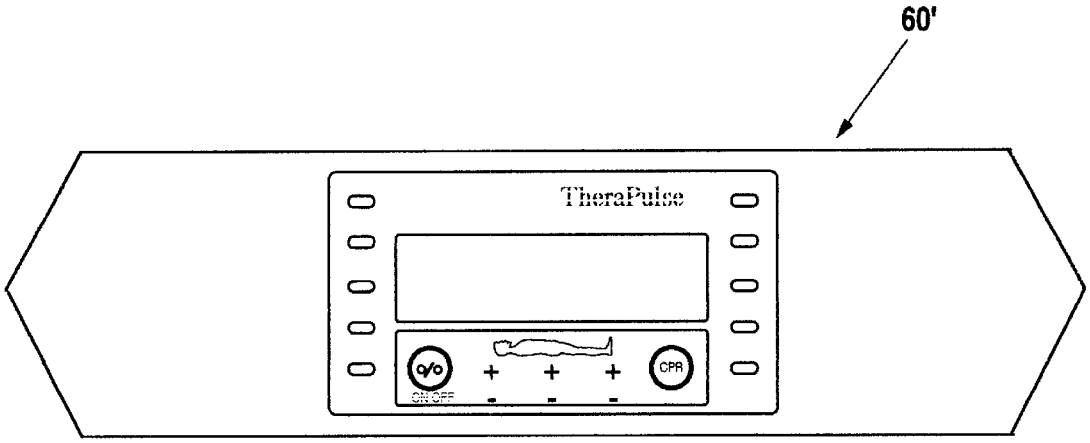
FIG. 5 shows the control panel of an alternative embodiment of the present invention.

FIG. 5 provides frontal view of the TheraPulse Light control panel 60'. This control interface has the power switch integral with the control panel membrane.

Figure 6:
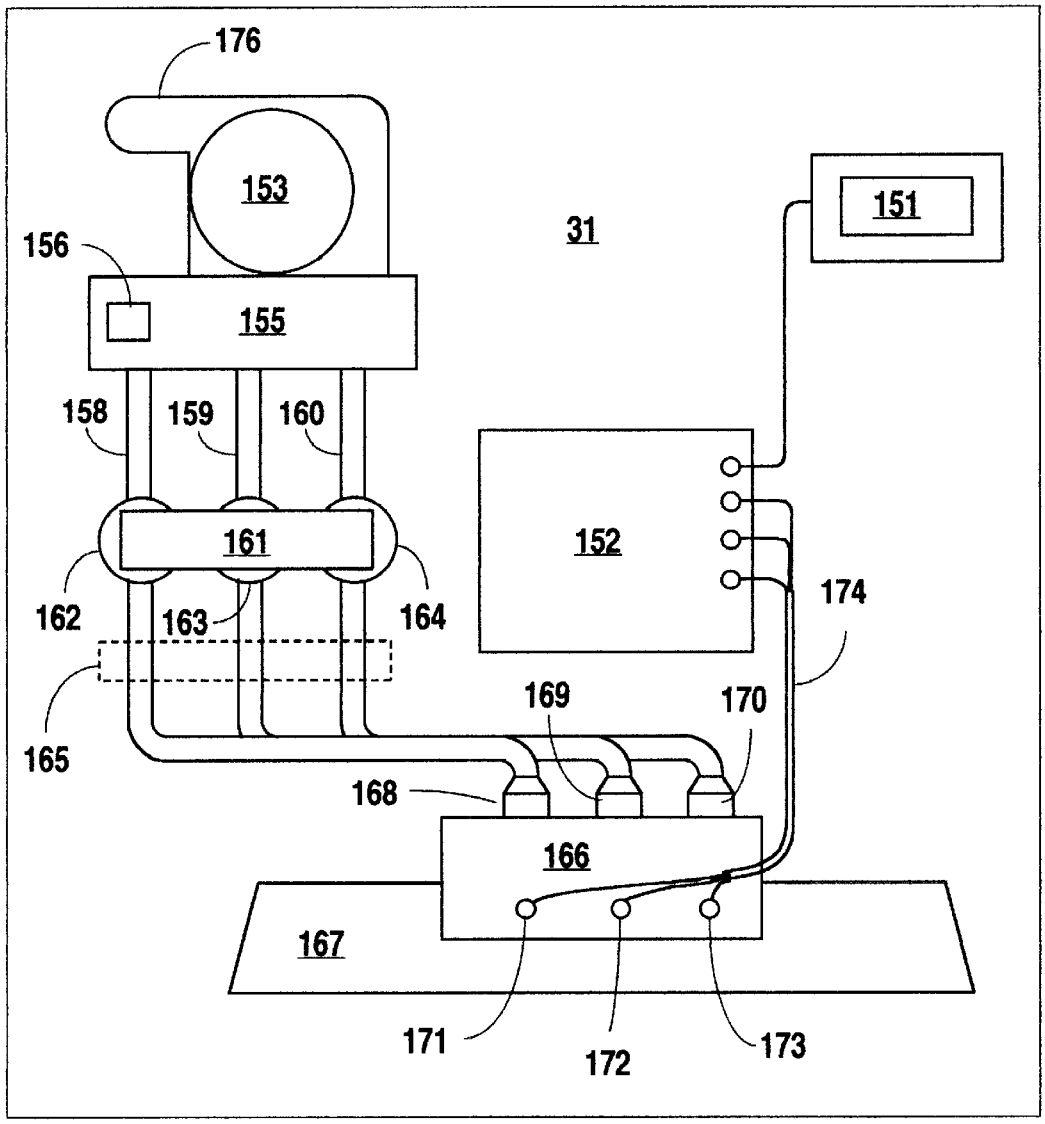
FIG. 6 is a schematic of one embodiment of the modular control assembly of FIG. 2.

Referring to FIG. 6, baseboard 31 is a rigid, phenolic, flat, rectangular board measuring approximately 36.5 inches wide, 26 inches front to back, and 0.25 inches thick; two of its adjacent corners are rounded to a radius of approximately 5 inches. Baseboard 31 is of such material so as to be machine bolt thread tapable to accept machine bolts without need for nuts. Holes for handholds are cut into baseboard 31. at opposite sides; the presently preferred dimensions for such handholds are approximately 1.75 inches wide by 5 inches long. Further reference to FIG. 6 shows schematically the components inside first preferred embodiment of blower control assembly 32. Components that constitute blower control assembly 32 are affixed to baseboard 31.

Control panel 60 protrudes from the foot end of the bed frame 20 as depicted in FIG. 1, but does not extend beyond the footprint established by frame 20. Alternate embodiments for equipping conventional bed frames can be achieved with baseboard options when manufacture supplied baseboards of the same shape, or substantially the same shape as baseboard 31, shown in FIG. 2, are provided by the bed frame manufacturer.

Such electronic, electromechanical, and mechanical devices schematically depicted in FIG. 6 are substantially similar to those found in the First Step Select mattress system available from assignee. The individual devices and components are well known to those skilled in the art and therefore do not require detailed description herein. electronic, electromechanical, and mechanical devices herein are operatively connected to baseboard 31, either directly, or to a bracket such as bracket 176 that is preferably fabricated from a corosion resistant easily machineable metal such as aluminum. Bracket 176 is in turn fastened to baseboard 31 presenting a somewhat "flat" configuration upon baseboard 31. Mounting of individual components to baseboard 31 may be accomplished by use of standard machine bolt screws into holes threaded into baseboard 31, as are well known in the art, or in any other conventional manner known to the art that does not have an adverse impact on the operation of the present invention.

No bolts or other fastening devices should extend out the opposite side of baseboard 31 more than 1/64 to 1/32 of an inch; that being the side of baseboard 31 upon which mattress 40 rests. Although there is nothing unique about the method of mounting the individual, components to baseboard 31, any alternative mounting method is contemplated by the teachings of this invention. For example, all of the components could be mounted to a chassis, which could in turn be mounted to baseboard 31.

A molded, high impact plastic, contoured shroud, 201, shown partially in FIG. 2, preferably covers all of the devices and components of blower control assembly 32 when affixed to baseboard 31, and is held in place to it by machine screws. Shroud 201 has openings for access to power switch assembly 151, features a filtered air inlet for blower motor 153, and a cut-away area to receive and accommodate a control panel 60. Of particular importance to the shape of the shroud is a 5 inch wide by 4 inch deep channel. 205 that runs the length of shroud 201. Channel 205 (partially visible in FIG. 2) is of sufficient depth, width, and length to accommodate mechanical features of bed frame 20, especially the centrally disposed jack-screws, also known as worm gears, of bed 20 that articulate the foot baseboard portion of bed 20.

Air/heater manifold 155 and valve assembly 161 are mounted to metal bracket 177, which is in turn, mounted to baseboard 31. Metal bracket 177 is longer than it is wide, is bent at several substantially right angles to provide plateaus of various heights from baseboard 31 to accommodate mounting of valve assembly 161 and allow hoses 158, 159, and 160 to pass from air/heater manifold 155 beneath pinch valves 162, 163, and 164, and continue on to hose port block 166.

Pinch valve controllers 162, 163, and 164 regulate the volume of air that flows through air hoses 158, 159, and 160. Pinch valve assemblies 162, 163, and 164 respond to electrical signals produced by electronic control board 152.

Air hoses 158, 159, and 160 proceed on from through valve assembly 161 to three ports, respectively, on one face of hose port block 166. On the obverse side of hose port block 166 are three air hose outlets 33, 34, and 35, depicted in FIG. 2 and FIG. 3. From these outlets 33, 34, and 35, air hoses proceed to mattress 40.

On an adjacent face of hose port block 166 are three, air pressure sensing ports 171, 172, and 173. Proceeding from the pressure sensing ports 171, 172, and 173 are three air pressure sensor, spaghetti hoses 168, 169, and 170, that connect to three pressure transducers on and integral to electronic control board 152. This air pressure sensing configuration provides feedback signals to electronic control board 152. A fourth pressure transducer integral to electronic control board 152 is linked by yet another air spaghetti hose to air/heater manifold 155 to provide air temperature feedback to electronic control board 152.

These three pressure ports 171, 172, and 173 provide pneumatic feedback to electronic control board 152 for the feet, body and head aspects of air being delivered to those respective zones of air mattress 40. The proximate end of a flat ribbon electric cable attaches to electronic control board 152 and the distal end thereof attaches to a First Step Select membrane panel 62 of the preferred embodiment as shown in FIGS. 1–3. An alternative control panel is the TheraPulse Light depicted in FIG. 5.

In sum, FIGS. 1–6 show a basic bed frame 20 adapted to accommodate modular control assembly 30, and figure by figure zoom in to reveal greater detail of blower control assembly 32 and alternate control panels 60, 60'.

Figure 7:
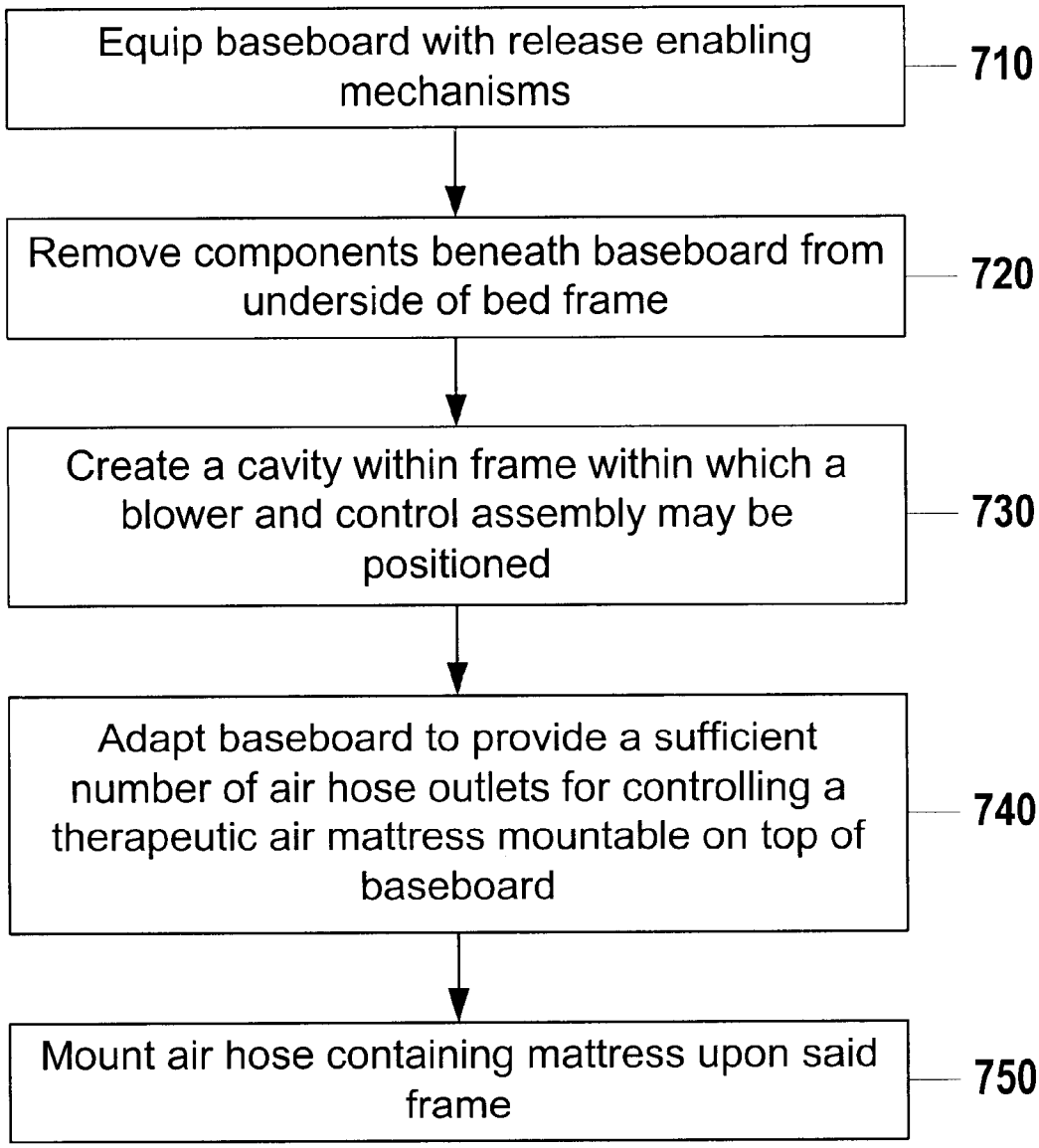
FIG. 7 is a diagram illustrating one embodiment of a method of modifying a conventional baseboard containing bed frame so as to enable receipt of a modular control system for specialty patient support systems therein.

FIG. 7 is a diagram illustrating one embodiment of a method of modifying a conventional baseboard containing bed frame so as to enable receipt of a modular control system for specialty patient support systems therein, comprising, in block 710, equipping said baseboard with release enabling mechanisms; in block 720, removing components that are beneath said baseboard from the underside of said bed frame; in block 730, creating a cavity within said frame within which a blower and control assembly may be positioned; in block 740, further adapting said baseboard to provide a sufficient number of air hose outlets for controlling a therapeutic air mattress mountable on top said base board; and in block 750, mounting said air hose containing mattress having a plurality of air hoses, said air hoses being connected to said outlets, upon said frame.

Many references have been made in this detailed description to particular commercial embodiments, such as the First Step Select, the TheraPulse Light and others. It should be recognized by those of ordinary skill in the art, however, that such reference is made because that is Applicant's present perspective—to utilize the present invention together with such products. It is readily contemplated, however, that the present invention will be utilized with many other mattress systems as are available from Applicant's current and future competitors.

Accordingly, the following is claimed:

1. A therapeutic patient support system adaptable for compact installation within a conventional hospital bed frame containing a mattress baseboard; the system comprising:

an inflatable pressure reducing mattress, a replacement baseboard for replacing a portion of the mattress baseboard of the conventional hospital bed frame, and a mattress power/control module encompassed within a single molded housing mounted on an underside of the replacement baseboard.

2. A system according to claim 1 wherein a control panel portion of said module is positioned so as to be viewable by a caregiver of a user of said system.

3. A system according to claim 2 wherein said control panel projects beyond a footboard of said bed.

4. A therapeutic control system adaptable for compact installation within a conventional hospital bed frame containing mattress baseboard; the system comprising:

an inflatable pressure reducing mattress, a replacement baseboard for replacing a portion of the mattress baseboard of the conventional hospital bed frame, a mattress power/control module mounted on an underside of the replacement baseboard, and a receptacle in a top of the mattress power/control module that is adaptable to receive air hoses connected to the pressure reducing mattress, and wherein the replacement baseboard includes an aperture over the receptacle that provides access to the receptacle.

5. A therapeutic patient support system that interactively coacts with a bed frame having a conventional baseboard that is suitable for directly supporting a conventional medical mattress, the system comprising:

a replacement baseboard to replace a portion of the conventional baseboard;

a blower assembly mounted to the underside of said replacement baseboard, the blower assembly being enclosed within a molded housing; and a control panel integral with and projecting from the molded housing, the control panel operable to control the operation of said blower assembly, said control panel being positioned in a manner so as to be viewable by a caregiver of a user of said system.

6. A system according to claim 5 that additionally comprises a support assembly for supporting said replacement baseboard wherein said support assembly defines a blower-receiving cavity beneath an aperture in said replacement baseboard.

7. A method of modifying a conventional baseboard containing bed frame so as to enable receipt of a modular control system for specialty patient support systems therein, comprising:

equipping said baseboard with release enabling mechanisms;

removing components that are beneath said baseboard from the underside of said bed frame;

creating a cavity within said frame within which a blower and control assembly may be positioned;

further adapting said baseboard to provide a sufficient number of air hose outlets for controlling a therapeutic air mattress mountable on top said base board; and mounting said air hose containing mattress having a plurality of air hoses, said air hoses being connected to said outlets, upon said frame.

* * * * *

UNITED STATES PATENT AND TRADEMARK OFFICE

CERTIFICATE OF CORRECTION

PATENT NO. : 6,467,111 B1 
DATED : October 22, 2002
INVENTOR(S) : John H. Vrzalik and Cesar Z. Lina It is certified that error appears in the above-identified patent and that said Letters Patent is hereby corrected as shown below:

Column 7,
Lines 37 and 38, insert the article -- a -- between the words "containing" and "mattress"

Signed and Sealed this

Fourth Day of November, 2003

JAMES E. ROGAN
*Director of the United States Patent and Trademark Office*